US005717159A

United States Patent [19]

Dixon et al.

[11] Patent Number: 5,717,159

[45] Date of Patent: Feb. 10, 1998

[54] LEAD-FREE PRECUSSION PRIMER MIXES BASED ON METASTABLE INTERSTITIAL COMPOSITE (MIC) TECHNOLOGY

[75] Inventors: George P. Dixon, Alexandria, Va.; Joe A. Martin, Espanola, N. Mex.; Don Thompson, Ridgecrest, Calif.

[73] Assignee: The United States of America as represented by the Secretary of the Navy, Washington, D.C.

[21] Appl. No.: 816,747

[22] Filed: Feb. 19, 1997

[51] Int. Cl.[6] ..... C06B 33/12; F41F 1/40

[52] U.S. Cl. ..... 149/40; 149/37; 149/108.2; 102/204; 102/205

[58] Field of Search ..... 149/37, 40, 108.2; 102/204, 205

[56] References Cited

U.S. PATENT DOCUMENTS

| | | | |
|---|---|---|---|
| 3,703,144 | 11/1972 | Colburn, Jr. | 149/37 X |
| 4,041,217 | 8/1977 | Collins | 149/37 |
| 4,089,715 | 5/1978 | Scherzinger | 149/6 |
| 4,090,895 | 5/1978 | Outten | 149/22 |
| 5,462,306 | 10/1995 | Barcaskey | 149/35 |
| 5,552,001 | 9/1996 | Fearon | 149/77 |

*Primary Examiner*—Peter A. Nelson

*Attorney, Agent, or Firm*—Melvin J. Sliwka; Gregory M. Bokar; Stephen J. Church

[57] ABSTRACT

A lead-free percussion primer composition and a percussion cup containing the composition. The lead-free percussion primer composition is comprised of a mixture of about 45 wt % aluminum powder having an outer coating of aluminum oxide and molybdenum trioxide powder or a mixture of about 50 wt % aluminum powder having an outer coating of aluminum oxide and polytetrafluoroethylene powder. The aluminum powder, molybdenum trioxide powder and polytetrafluoroethylene powder has a particle size of 0.1 μm or less, more preferably a particle size of from about 200–500 angstroms.

11 Claims, 1 Drawing Sheet

LEAD-FREE PRECUSSION PRIMER MIXES BASED ON METASTABLE INTERSTITIAL COMPOSITE (MIC) TECHNOLOGY

STATEMENT REGARDING FEDERALLY SPONSORED RESEARCH OR DEVELOPMENT

The invention described herein may be manufactured and used by or for the Government of the United States of America for governmental purposes without the payment of any royalties thereon or therefor.

MICROFICHE APPENDIX

Not Applicable.

BACKGROUND OF THE INVENTION

1. Field of the Invention

This invention relates in general to lead-free percussion primer mixes for use in a primer cup assembly, and more particularly, to an improved primer mix based on metastable interstitial composite (hereinafter MIC) technology.

2. Description of the Prior Art

Conventional percussion primer mixes used in percussion cup assemblies for almost all calibers of ammunition utilize primer compositions based on lead styphnate, lead azide, antimony sulfide, barium nitrate and other materials that are environmentally objectionable. These primer compositions also require expensive handling procedures during both production and disposal. Several tons of these toxic materials and heavy metals are used annually by U.S. commercial suppliers in the production of percussion primer mixes. The human body has difficulty in removing lead that has been absorbed by the body and dissolved in the blood. Consequently, a primary concern is the amount of lead absorbed by humans from exposure to primer mix constituents, as well as the combustion by-products of lead-based primer compositions.

Primer mixes used in military ammunition must function reliably between the temperatures of −65° F. to +160° F. The reliability of current lead-free primer compounds degrade as temperatures approach −65° F. The ability of a percussion primer to function reliably at low temperatures becomes particularly important when percussion primed ammunition is used in aircraft gun systems which are routinely exposed to severe cold.

A common non-lead primer composition currently being utilized is dinitrodiazophenol (hereinafter DINOL). The use of DINOL meets requirements for commercial applications, but it does not fully meet military requirements. Attempts in improving the reliability of such primers has resulted in an increase in the hazards associated with their use in U.S. military weapons.

Many commercial manufacturers of primers are currently involved in the development and testing of new energetic materials for use in primers for small caliber ammunition. However, none of the new primer mixes meet the requirements imposed for use in military applications.

Energetic compositions are disclosed in U.S. Pat. No. 5,266,132 which consist of layers of two reactive substances which are aluminum and cupric oxide, wherein the layers are formed by thin fill deposition. In this composition each layer of aluminum is separated from at least one layer of cupric oxide by a buffer layer.

It is therefore an object of the present invention to provide for a percussion cup an improved primer mix which has little dependence on temperature and is reliable at low temperatures.

It is another object of the invention to provide for a percussion cup an improved primer composition which does not contain toxic materials and whose by-products are non-toxic and environmentally benign.

BRIEF SUMMARY OF THE INVENTION

According to the present invention there is provided an improved lead-free percussion primer composition comprising particulate aluminum and molybdenum trioxide having a particle size of about 0.1 μm or less. The molybdenum trioxide is present in an amount sufficient to oxidize the aluminum particles.

In a preferred embodiment, TEFLON powder (polytetrafluoroethylene) is mixed with the particulate aluminum and molybdenum trioxide.

In another embodiment of the present invention, a lead-free percussion primer composition comprises particulate aluminum and polytetrafluoroethylene having a particulate size of about 0.1 μm or less.

Where the primer composition according to the present invention comprises aluminum and molybdenum, it is preferred that the aluminum constitute about 45 wt % of the composition. When the primer composition of the present invention comprises particulate aluminum and TEFLON, the aluminum constitutes about 50 wt % of the composition.

DETAILED DESCRIPTION OF THE INVENTION

Figure 1:
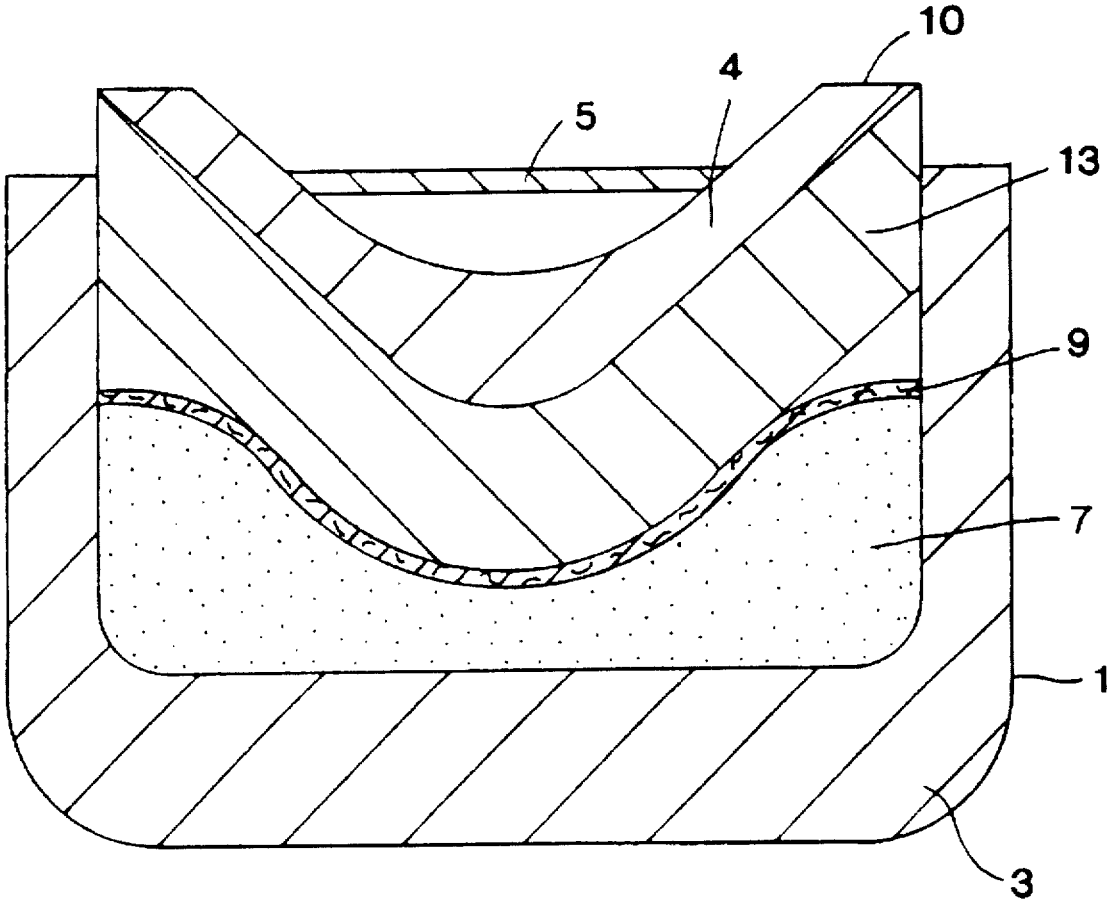
FIG. 1 is a cross sectional view of a primer cup assembly illustrating the placement of the primer compositions of the present invention.

A primer cup assembly conventionally used in ammunition is shown generally at 1 (FIG. 1) and comprises a brass primer cup 3 having a rim portion 5. The primer cup portion 3 contains a primer mix 7. A paper disc 9 rests on the surface of primer mix 7 so as to contain primer mix 7 in said primer cup assembly 3 and to prevent moisture from reaching the primer mix 7. A saddle shaped anvil indicated generally at 10 is shown with a top surface 4 and a cross sectional area 13. The anvil 10 rests upon and is in contact with paper disc 9.

The percussion primer composition of the present invention, unlike the commonly used lead-based explosive compositions which detonate, react together and cause an extremely intense exothermic reaction. This reaction liberates a great amount of heat and burning particles which causes the main charge of gun powder in the ammunition to ignite and rapidly burn.

In a preferred embodiment of the invention, the percussion primer composition 7 is a mixture of aluminum powder and molybdenum trioxide or a mixture of aluminum powder and Teflon (polytetrafluoroethylene). The particle sizes of the powder is preferably about 0.1 μm or less, more preferably from about 0.02–0.05 μm. For the $Al/MoO_3$ combination, aluminum typically constitutes about 45 wt % and $MoO_3$ typically constitutes about 55 wt % of the composition. Weight percentages for the Al/Teflon combination are about 50 wt % for each of the species.

The by-products of the reaction of aluminum and molybdenum trioxide consists of alumina (a ceramic) and molybdenum, both non-toxic and environmentally benign. A substitute, lead-free, primer mix would also have to provide the same or greater performance (energy output) and reliability under stated conditions (−65° F. to +160° F., total propellant ignition). MIC materials satisfy these requirements.

The primer compositions of the present invention provide a significant increase in output energy as compared to a standard primer mix and can be tailored to provide optimal performance. Thus, the primer composition of the present invention provides greater performance in primer mix performance while maintaining the current design of existing percussion primers. This eliminates the need to redesign the primer and associated components. The relative insensitivity of the primer compositions of the present invention to low temperatures provides a primer mix that will reliably function at temperatures as low as −65° F. With a cook off temperature that approaches 900° F., these compositions far exceed the required high temperature requirement of +160° F. for the safe use of military ammunition.

What is claimed is:

1. A lead-free percussion primer composition comprising:

a mixture of aluminum powder and molybdenum trioxide powder, wherein said aluminum powder and said molybdenum trioxide have a particle size of about 0.1 μm or less, and said aluminum powder has an outer coating of aluminum oxide.

2. The lead-free percussion primer composition of claim 1, wherein said aluminum and molybdenum powder has a particle size of from about 200–500 angstroms.

3. The lead-free percussion primer composition of claim 1, wherein molybdenum trioxide is present in an amount sufficient to oxidize said aluminum powder.

4. The lead-free percussion primer composition of claim 1, further comprising powdered polytetrafluoroethylene.

5. A lead-free percussion primer composition comprising particulate aluminum and polytetrafluoroethylene having a particle size of 0.1 μm or less, wherein said particulate aluminum has a coating thereon of aluminum oxide.

6. The lead-free percussion primer composition of claim 5, wherein the particle size is from about 200–500 angstroms.

7. The lead-free percussion primer composition of claim 1 wherein the aluminum powder constitutes about 45 wt %.

8. The lead-free percussion primer composition of claim 5, wherein the aluminum powder constitutes about 50 wt %.

9. A percussion cup containing the composition of claim 1.

10. A percussion cup containing the composition of claim 4.

11. A percussion cup containing the composition of claim 5.

* * * * *